US005649389A

United States Patent [19]

Coddens

[11] Patent Number: 5,649,389

[45] Date of Patent: Jul. 22, 1997

[54] SUPPLEMENTAL WINDOW ARRANGEMENT

[75] Inventor: Donald Coddens, South Bend, Ind.

[73] Assignee: Therm-O-Lite, Inc., South Bend, Ind.

[21] Appl. No.: 104,337

[22] Filed: Aug. 9, 1993

[51] Int. Cl.[6] ..... E05D 13/00

[52] U.S. Cl. ..... 49/419; 49/176; 49/501

[58] Field of Search ..... 49/454, 463, 176, 49/163, 168, 445, 446, 428, 429, 430, 419, 501

[56] References Cited

U.S. PATENT DOCUMENTS

| | | | |
|---|---|---|---|
| 1,111,621 | 9/1914 | Singer . | |
| 2,170,877 | 8/1939 | Simon . | |
| 2,219,699 | 10/1940 | Owen . | |
| 2,288,465 | 6/1942 | Knudsen . | |
| 2,321,554 | 6/1943 | Milnor . | |
| 2,565,447 | 8/1951 | Andresen et al. . | |
| 2,802,243 | 8/1957 | Cialella . | |
| 2,877,516 | 3/1959 | Bobel . | |
| 2,976,583 | 3/1961 | McCarthy . | |
| 3,080,023 | 3/1963 | Armstrong . | |
| 3,153,819 | 10/1964 | Bond . | |
| 3,239,892 | 3/1966 | Johnson | 49/430 X |
| 3,248,821 | 5/1966 | Johnson | 49/430 X |
| 3,291,193 | 12/1966 | Hagerty et al. . | |
| 3,399,490 | 9/1968 | Hettinger | 49/446 X |
| 3,443,624 | 5/1969 | Toth . | |
| 3,466,806 | 9/1969 | Teggelaar et al. . | |
| 3,483,658 | 12/1969 | Dallaire | 49/419 |
| 3,534,800 | 10/1970 | Guttman . | |
| 3,600,854 | 8/1971 | Dallaire | 49/419 X |
| 3,703,920 | 11/1972 | Debs . | |
| 3,722,572 | 3/1973 | Hall . | |
| 4,034,510 | 7/1977 | Huelsekopf | 49/419 |
| 4,079,558 | 3/1978 | Gorham . | |
| 4,160,348 | 7/1979 | Chapman et al. . | |
| 4,223,481 | 9/1980 | Page . | |

FOREIGN PATENT DOCUMENTS

| | | |
|---|---|---|
| 2607937A1 | 9/1977 | Germany . |
| 204755 | 3/1963 | Sweden . |
| 1025833 | 4/1966 | United Kingdom . |

OTHER PUBLICATIONS

EDI Window Systems Advertising Literature.
Therm–O–Lite Brochure, "Interior Insulating Window and Patio Door Systems".
Therm–O–Lite Advertisement, "Finally. Patio door insulation that doesn't seal you in. New Therm–O–Lite® *Interior* sliding patio storm door".
Sears Advertisement, "Introducing . . . Sears Window Systems Why Replace When You Can Insulate!".
Therm–O–Lite® Advertisement, "A beautiful way to save."
Sugar Creek Window and Door Corporation Combination Storm/Screen Windows Brochure, 1991.

*Primary Examiner*—Kenneth J. Dorner
*Assistant Examiner*—Jerry Redman
*Attorney, Agent, or Firm*—Barnes & Thornburg

[57] ABSTRACT

An interior storm window assembly, mounted to an interior building wall over a window opening containing a prime window therein is provided, having double hung, vertically movable window pane members received within opposing, self-locating vertical channels and pivotally attached to adjustable weight balancing elements within those channels. The frame structure of the window assembly, including the peripheral rail about each window pane member and the vertical channels, is formed from plastic material, such as vinyl, having low thermal conductivity, and a rigid, reinforcing rod, preferably of metal, is inserted within the plastic rail at the bottom of each window pane member. The vertical channels apply pressure inwardly to those peripheral rails to releasably retain the window pane members in vertical orientation as well as urge the peripheral rails laterally into sealing contact with the vertical channels. An interlocking seal arrangement is also provided between the peripheral rails for further securing against air flow when the window assembly is closed. Weather stripping on the peripheral rails is biased into engagement with compressive ribs on the vertical channels, creating a tortuous air flow path therebetween.

(List continued on next page.)

6 Claims, 6 Drawing Sheets

U.S. PATENT DOCUMENTS 4,227,346 10/1980 Kubik .
4,351,131 9/1982 Kubik .
4,369,828 1/1983 Tatro .
4,370,830 2/1983 Schaefer et al. .
4,409,758 10/1983 Dickerson et al. .
4,459,778 7/1984 Ball .
4,484,611 11/1984 Anderson .
4,521,991 6/1985 Sayer et al. ..... 49/176 X
4,561,223 12/1985 Gold et al. .
4,611,648 9/1986 Anderson .
4,630,400 12/1986 Hsieh ..... 49/501 X
4,667,441 5/1987 Coddens .
4,674,246 6/1987 Giguere ..... 49/419 X
4,676,024 6/1987 Rossman .
4,685,502 8/1987 Spangenberg .
4,702,296 10/1987 Anderson .
4,723,586 2/1988 Spangenberg .
4,733,510 3/1988 Werner .
4,815,246 3/1989 Haas .
4,922,658 5/1990 Coddens .
5,000,242 3/1991 Coddens .

SUPPLEMENTAL WINDOW ARRANGEMENT

BACKGROUND AND SUMMARY OF THE INVENTION

The present invention relates generally to windows for use in buildings and other habitable structures, whether static or mobile. More particularly, the present invention relates to supplemental window assemblies installed about prime windows.

While prime windows, those windows generally usable on a stand-alone basis in fixed buildings, mobile homes, travel trailers and other habitations, are sufficient for structural integrity and habitation security, they are often found to be an insufficient thermal barrier. To conserve the energy necessary for heating and/or cooling a building it has, for example, been suggested to employ supplemental windows in addition to the prime windows. Such supplemental windows have included exterior and interior "storm" windows mounted over the prime windows with a "dead air" space therebetween.

Such supplemental windows are structurally and functionally distinct from prime windows. As noted above, prime windows are typically constructed to provide structural integrity and security for the building. Usually being installed during initial construction or overall renovation of the building, prime windows tend to define the spacial constraints of the window opening, rather than be limited by it. In addition, operating mechanisms of prime windows, such as balancing weights, can be mounted within the wall space outside of and adjacent to the window opening. Prime windows also tend to be relatively heavy and bulky. Further, prime windows typically require professional or highly experienced installers. As a result, and especially where window pane tilt features are employed (as with casement or awning windows), prime windows tend to be relatively expensive.

Supplemental windows, however, are primarily intended to protect the prime window and reduce thermal loses therethrough. In many instances, supplemental windows are intended to be installed by the building owner and/or relatively unexperienced workers. As a result, supplemental windows are preferably lightweight, uncomplicated and inexpensive. To avoid detracting from the appearance of either the building in general or the prime window itself and to fit within often tight pre-existing spacial constraints, supplemental windows have tended to have minimal framework, the visible bulk of the window assembly being the window panes.

Various such supplemental windows are known and, in general, those windows are successful in their intended functions. However, supplemental windows have been typically subject to certain shortcomings and, in some circumstances, have not been practical to use at all. For example, exterior storm windows are often constructed from metal, such as aluminum, in order to have sufficient durability and rigidity for mounting on the exterior face of the building. Frames for these windows have tended to be narrow and simple, merely to provide a channel for the window pane motion in a vertical plane, in order to save on overall weight and cost and to minimize visual distraction from the building exterior.

However, such metal frames are relatively poor thermal insulators, channel-to-pane sealing is often relatively poor without complicated frame designs (especially where the pane is even slightly out of square), and glass weight alone can make raising and lowering of the window panes, as for cleaning, difficult for an average user. Also, "weep holes" or passageways from the environment to the dead air space are usually provided to avoid condensation build up between the exterior storm window and the prime window. Thus, an optimal thermal barrier between the windows is not achieved.

In those instances where the prime window has a pane which can be operated to tilt outward from the vertical plane of the building wall, the close fit of the exterior storm window would prevent that operation. In addition to thereby precluding building ventilation when desired, cleaning the exterior of the prime window pane and the interior of the storm window pane is substantially complicated. Constructing the exterior storm window larger to avoid such difficulties, however, typically precludes removal of the storm window panes through the prime window for cleaning or replacement and makes the exterior visual impression of the storm window more pronounced. Such larger storm window assemblies are not even possible where, for example, shutters are closely mounted to the exterior of the prime window. Further, at certain heights and/or window sizes or in situations involving historic buildings or buildings subject to restrictive covenants, exterior storm windows are simply not available for use as a practical matter.

Interior storm windows, on the other hand, can be installed regardless of building height and legal restrictions on exterior building appearance, but suffer other disadvantages. Such windows have generally been mounted within the window opening or, as described in co-pending U.S. patent application Ser. No. 08/023,599, filed on Feb. 26, 1993, now U.S. Pat. No. 5,390,454, on the interior building wall outside of the window opening. In both cases these windows are preferably constructed with frames from plastic material, such as vinyl, to reduce thermal conductivity, weight, and expense. However, particularly in large windows subject to extended periods of direct sunlight, these materials have been found to sag and warp in response to the weight and thermal stresses. This sagging is destructive of the structural and air seal integrity of the window unit and can increase the difficulty of raising or lowering the window panes. Further, in tall windows vinyl material has been found to lack sufficient rigidity to maintain close air seals between the sides of the window pane and the receiving channels. Moreover, in those instances where such windows are installed within the window opening, custom sizing and installation are typically needed for each window opening, especially when retrofitting such storm windows to older buildings.

Like exterior storm windows, interior storm windows often block operation of prime windows having tilting panes, particularly if that storm window is installed within the window opening. In addition, it can be difficult, due to window pane weight, for an average user to raise, lower and/or remove the larger interior storm window panes for cleaning or access to the prime window. Also, even where the most minimal frame for interior storm windows is installed within the window opening, its dimensions are typically sufficient to block otherwise removable prime window panes, even if the storm window pane is small enough to be readily removed from that frame. Further, when the storm window pane is constructed out of square, with some frames the air seal integrity between the window pane and the receiving channels is degraded. In addition, both types of storm windows often employ latching mechanisms which require use of two hands simultaneously to open.

Accordingly, it is an object of the present invention to provide an improved window assembly to supplement a prime window in a building or other habitable structure. Other objects of this invention include providing:

1. a durable, inexpensive storm window that is easy to install to an existing building, 2. an interior storm window that is easy to open, clean and maintain, 3. a storm window with lower thermal conductivity and higher structural rigidity, 4. a window assembly having improved sealing against air flow therethrough, and 5. an interior storm window that does not interfere with operation, cleaning or maintenance of the associated prime window.

These and other objects of the present invention are attained in an interior storm window assembly, mounted to an interior building wall over a window opening containing a prime window therein, having double hung, vertically movable window pane members received within opposing, self-locating vertical channels and pivotally attached to adjustable weight balancing elements within those channels. The frame structure of the window assembly, including the peripheral rail about each window pane member and the vertical channels, is formed from plastic material, such as vinyl, having low thermal conductivity, and a rigid, reinforcing rod, preferably of metal, is inserted within the plastic rail at the bottom of each window pane member. The vertical channels apply pressure inwardly to the peripheral rails to releasably retain the window pane members in vertical orientation as well as urge the peripheral rails laterally into sealing contact with the vertical channels. An interlocking seal arrangement is also provided between the peripheral rails for further securing against air flow when the window assembly is closed. Weather stripping on the peripheral rails is biased into engagement with compressive ribs on the vertical channels, creating a tortuous air flow path therebetween.

The pivotable attachment of said window pane members allows them to be tilted out of the vertical plane of motion within the self-locating vertical channels to facilitate cleaning of both sides of the window panes and/or the prime window panes. The weight balancing elements allow even large, heavy window pane members to be raised and lowered by virtually any user and often with a single hand. The self-locating vertical channels accommodate out of square window pane members without loss of sealing. The rigid, reinforcing rods support the window pane weight to reduce sagging and distortion of the vinyl portions of the window pane members. Each of the vertical channels includes opposing inclined surfaces or ramps to engage the peripheral rails in a snap-fit connection to maintain vertical orientation of the window pane member.

Other objects, advantages and novel features of the present invention will become readily apparent from consideration of the drawings and detailed description below.

DETAILED DESCRIPTION OF PREFERRED EMBODIMENTS

Figure 1:
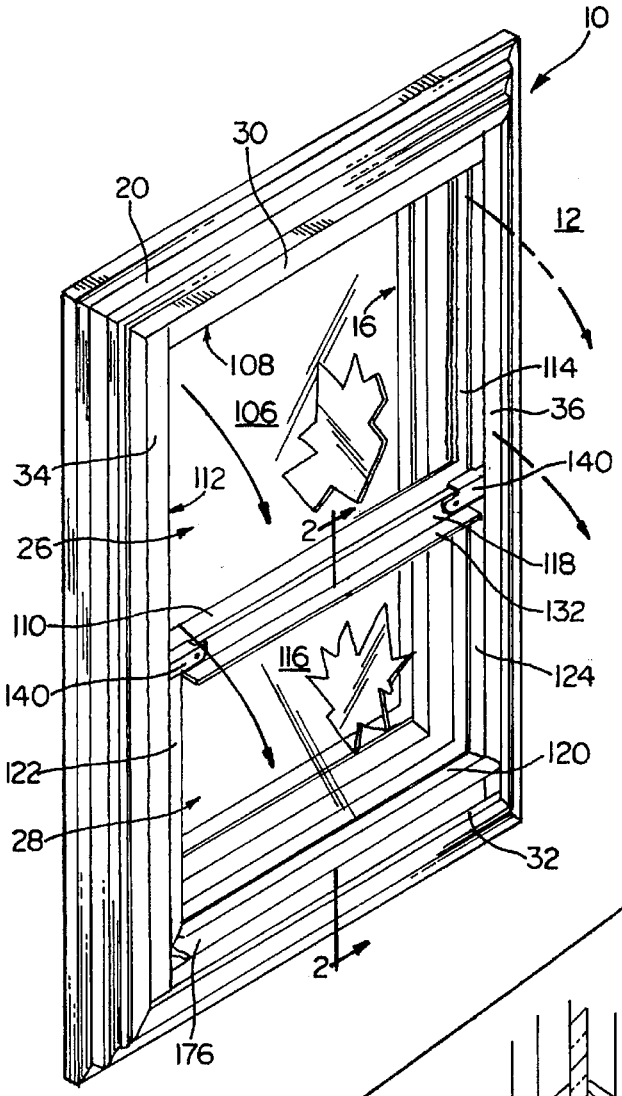
FIG. 1 shows an upper left perspective view of an interior storm window incorporating the present invention, as mounted on the interior wall of a building.
Figure 2:
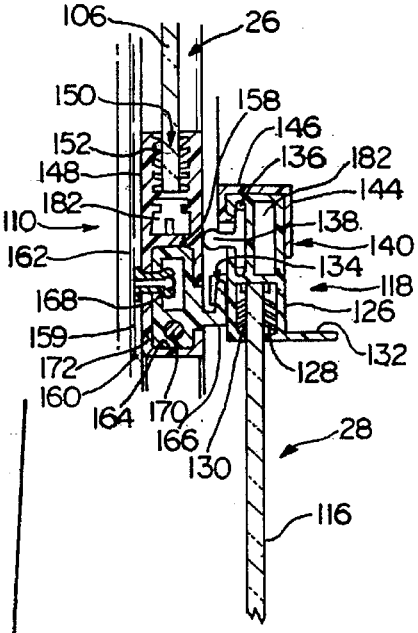
FIG. 2 shows an enlarged, partial cross-sectional view along line 2—2 of FIG. 1.
Figure 2:
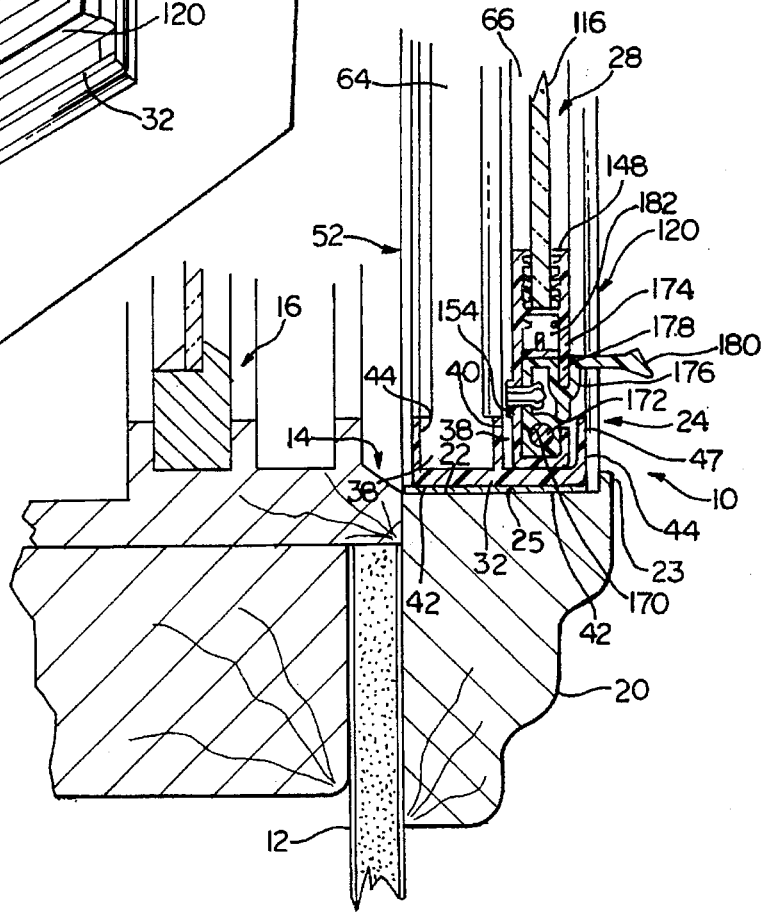
Figures 3, 4:
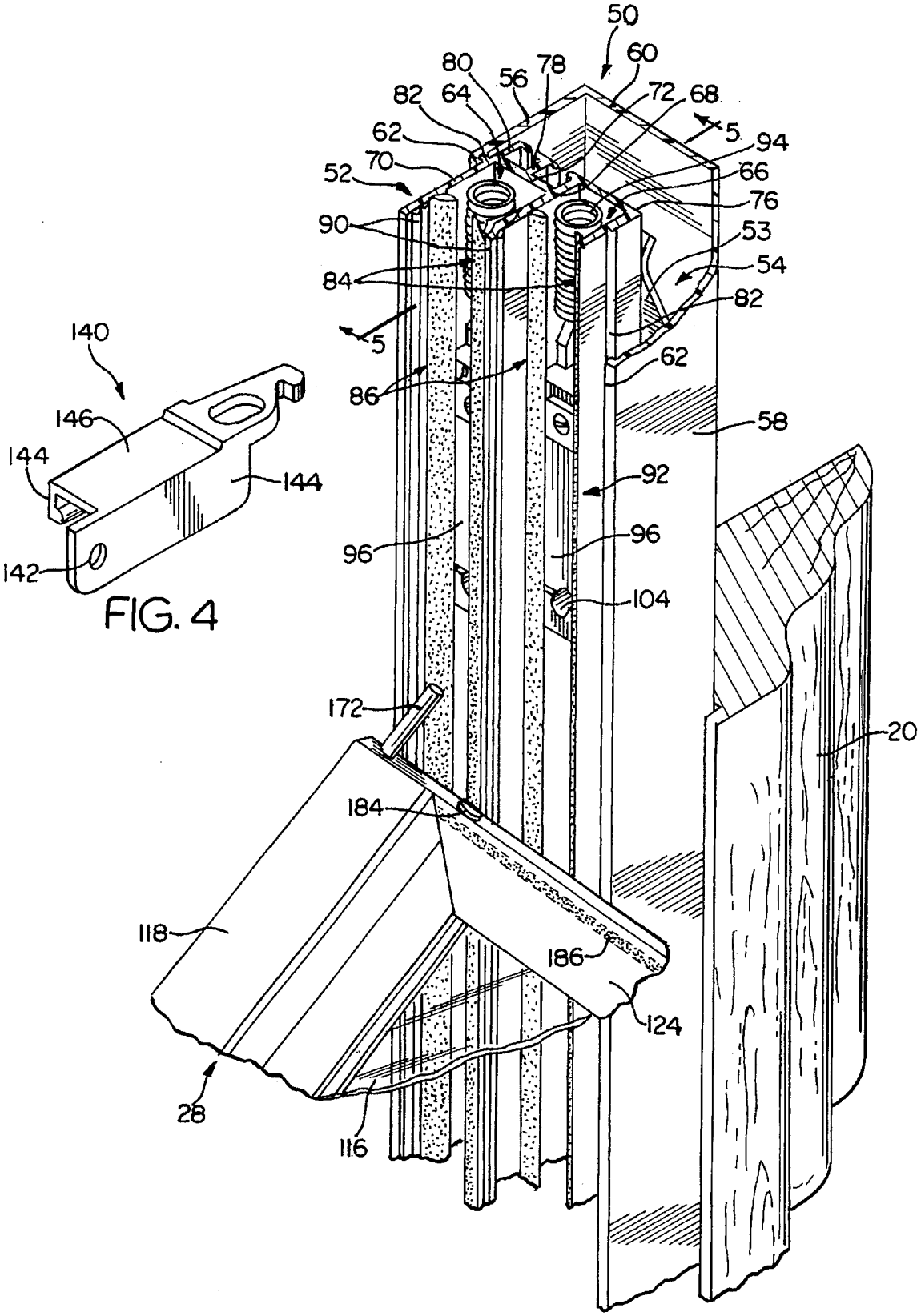
FIG. 3 shows an enlarged, upper left perspective cut away view of a portion of the right side of the interior storm window of FIG. 1 with the window pane member being removed.
FIG. 4 is an enlarged, upper left perspective view of the right latching element of the interior storm window of FIG. 1.
Figure 5:
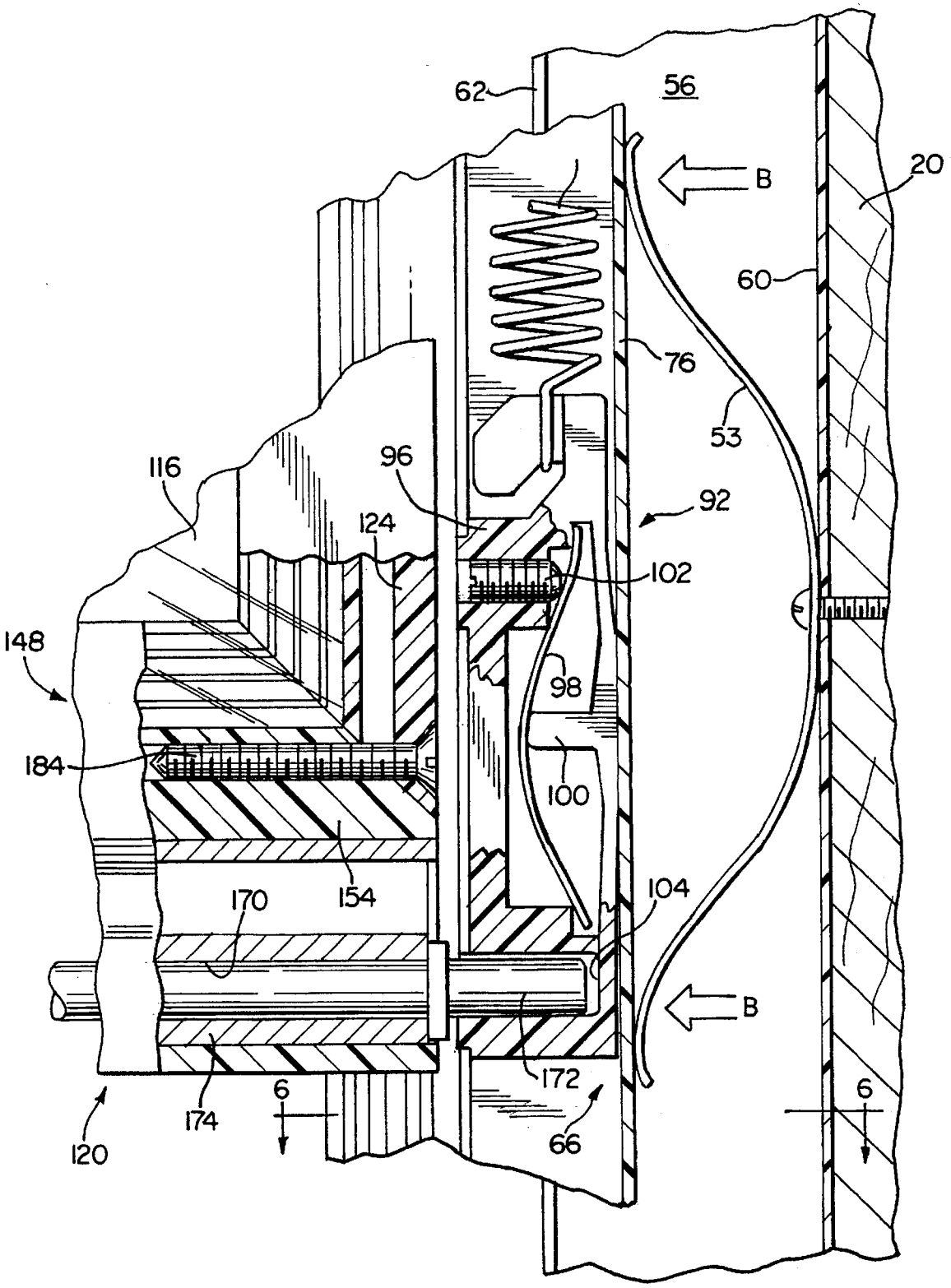
FIG. 5 is an enlarged, partial cross-sectional view along line 5—5 of FIG. 3 with the window pane member attached as shown in FIG. 1.
Figure 6:
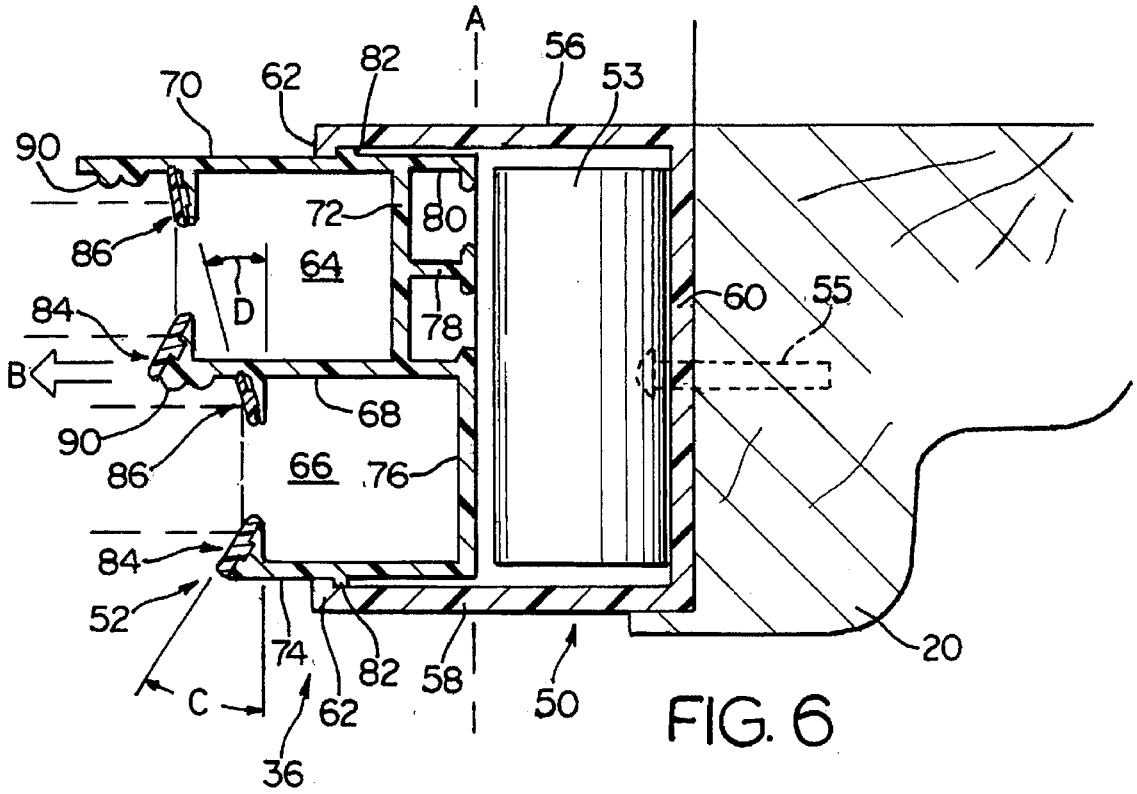
FIG. 6 is a partial cross-sectional view along line 6—6 of FIG. 5.

In the drawings, like numbers reference like elements. In general, the discussion below proceeds first with a description of structure and assembly. Subsequently, operational characteristics are discussed.

FIG. 1 shows an embodiment of the present invention as applied to a supplemental window mounted on the interior of a building or other habitable structure. In that illustration, interior window assembly 10 is mounted to building wall 12 over window opening 14 in wall 12. The preferred method of mounting is that described in the above-referenced co-pending U.S. patent application, and the disclosure of that application is specifically incorporated herein by reference. Accordingly, prime window assembly 16 is mounted in window opening 14, and interior window assembly 10 does not, for example, penetrate window opening 14.

Interior window assembly 10 preferably includes peripheral frame 20 constructed from wood and stained and finished prior to installation of interior window assembly 10 onto wall 12. Frame 20 has an interior recess or circumferential track 22 into which peripheral channel 24 is mounted for receiving upper window pane member 26 and lower window pane member 28 in a double-hung arrangement. Reminiscent of conventional double-hung windows, window pane members 26 and 28 are movable in relation to each other in offset, parallel vertical planes defined by peripheral channel 24. As shown in FIG. 1, in the completely closed position, window pane member 26 is disposed above window pane member 28 and only slightly overlapping. In that position, window pane member 26 is closer to the building exterior and prime window 16 than window pane member 28.

Peripheral channel 24 includes, for example, top section 30, bottom section 32, left section 34, and right section 36. Bottom section 32 is preferably an extruded element having a generally "W" or dual "U" cross-sectional configuration defining two separate rail channels or passageways 38. Rail channels 38 extend the longitudinal length of their section and share a common wall 40. Bight 42 of each rail channel bridges common wall 40 and an outer wall 44. A longitudinally extending sealing rib 47 is preferably formed on wall 44 within the rail channel closest to the interior of the building.

Left section 34 and right section 36 are, for example, formed identically and assembled between top section 30 and bottom section 32 as opposed, mirror images of each other. Thus, left and right sections 34 and 36 each include U-channel member 50, W-channel member 52 and biasing arrangement 54. U-channel member 50 includes a single, longitudinally extending chamber formed between inner side 56, outer side 58 and bight side 60. The free edges of sides 56 and 58 are inclined slightly toward each other (by, for example, approximately 3°) and each includes a ledge 62 extending toward the opposing side.

W-channel member 52 is formed as two offset, rail receiving channels 64 and 66 which share a side wall 68. Specifically, W-channel member 52 includes inner wall 70, bight 72 and side wall 68 to define channel 64 and outer wall 74, bight 76 and side wall 68 to define channel 66. Bight 72 and bight 76 are generally parallel, but offset such that bight 72 is closer to the window pane members. Leg element 78, protruding centrally from bight 72, and leg element 80, protruding from the inner side of bight 72 as an extension of inner wall 70, are formed to align with bight 76 along the same lateral line A and extend longitudinally with that line to be laterally coplanar with bight 76. Inner wall 70 and outer wall 74 each include a ledge 82 extending outwardly away from channels 64 and 66.

Figure 7:
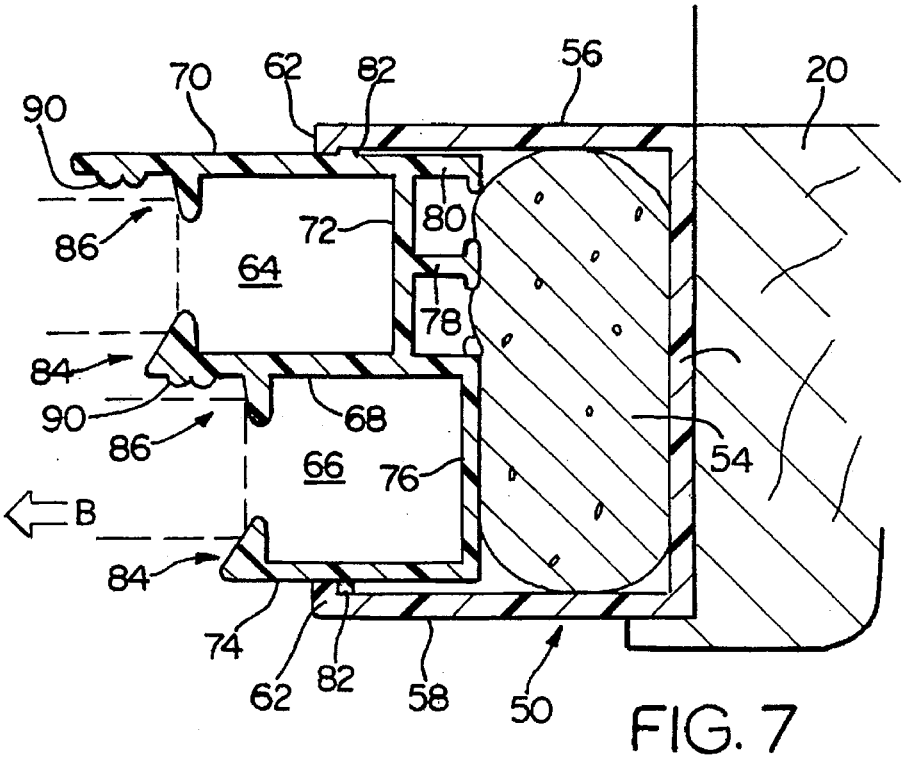
FIG. 7 is a partial cross-sectional view along line 6—6 of FIG. 5, as incorporating an alternative embodiment of the present invention.

W-channel member 52 is adapted to be closely fit and slidable within U-channel member 50. Biasing arrangement 54 is mounted within U-channel member 50 between bight side 60 and W-channel member 52. Biasing arrangement 54 is, for example, a plurality of leaf springs 53 spaced along the longitudinal length of W-channel 52 which are each secured in place by fasteners 55 passing through U-channel 50 and into channel 24 of frame 20. Alternatively, and as shown in FIG. 7, biasing arrangement 54 can be a strip of compressible, open cell foam material extending the longitudinal length of W-channel member 52. Preferably, this foam material substantially fills the space within U-channel member 50 between bight side 60 and W-channel member 52. Similarly, it is preferable that leaf springs 53 engage W-channel member 52 over substantially all of the lateral width of W-channel member 52. Either biasing arrangement preferably exerts a predetermined amount of pressure on W-channel member 52 to move toward the window pane members in the direction of lateral line B, toward the W-channel member in left section 34.

Channels 64 and 66 each include a first ramp or inclined surface 84 and a second ramp or inclined surface 86. These inclined surfaces are disposed on opposite sides of each such channel and form ledges directed into the channel. The angle of inclination of each inclined surface is defined as the angle formed by that inclined surface in a direction away from lateral line A or any lateral line parallel thereto. Preferably, the angle C of inclination of inclined surfaces 84 is greater than the angle D of inclination of inclined surfaces 86. As shown in the figures, angle C is approximately 30°, and angle D is approximately 15°.

A plurality of longitudinal ribs 90 are formed on W-channel member 52 adjacent each of second inclined surfaces 86. The spacing between ribs 90 and the associated second inclined surface 86 corresponds with the spacing between the weatherstripping on the side of the window pane members and the peripheral edge of the window pane members, as discussed below. It has been found advantageous to form top section 30, bottom section 32, U-channels 50 and W-channels 51 from vinyl.

Adjustable weight balancing elements 92 are disposed within each of channels 64 and 66 between bights 72, 76 and each corresponding pair of inclined surfaces 84, 86. In general, these weight balancing elements are of the type shown in U.S. Pat. No. 3,466,806. Preferably, weight balancing elements 92 are of the type sold by Newell Manufacturing Company of Albion, Indiana. As shown in the Figures, elements 92 include coil spring 94 secured at its upper end to the top edge (not shown) of W-channel member 52 and attached at its lower end to braking unit 96. Biasing element 98, a leaf spring, for example, is mounted within braking unit 96 to exert force on bridge 100 facing bight 72 or 76. Adjustment screw 102 is provided in braking unit 96 to alter the pressure biasing element 98 exerts on bridge 100. Braking unit 96 is also provided with cylindrical aperture 104.

Figure 8:
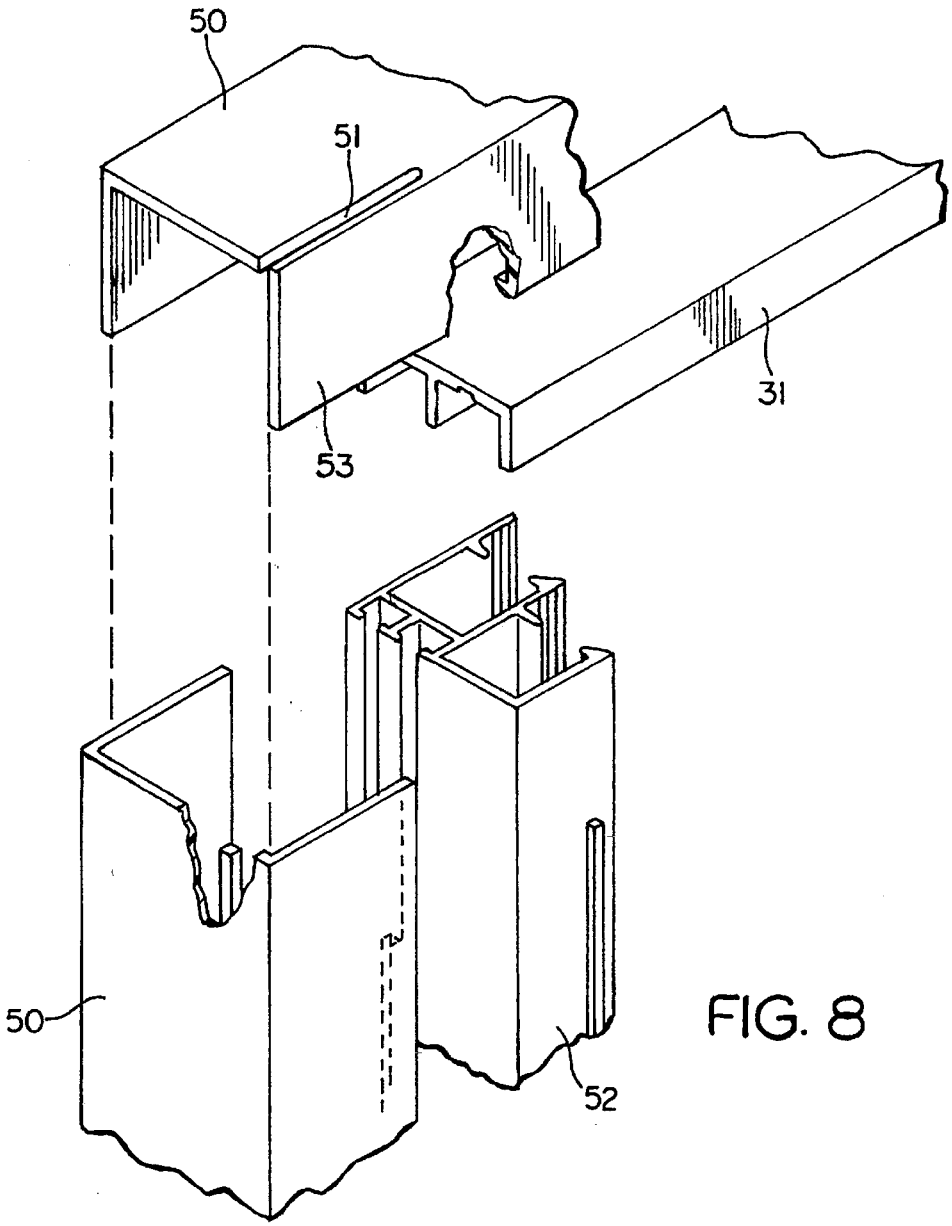
FIG. 8 is an exploded, perspective view of the upper left corner assembly of the interior window shown in FIG. 1.
Figure 9:
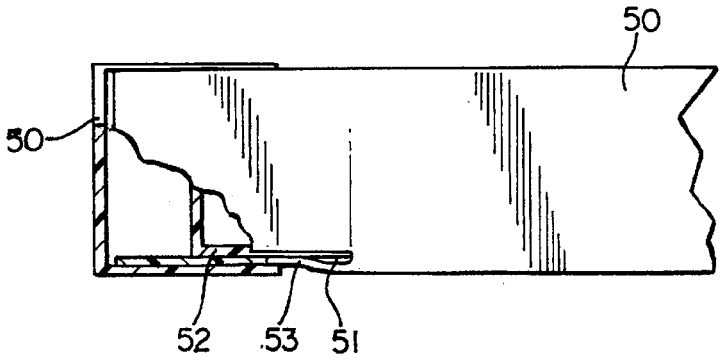
FIG. 9 is a partial cut-away view of the upper left corner of FIG. 8 fully assembled.

Top section 30 comprises a U-channel member 50 and a top member 31 (similar to bottom member 32) having a "M" cross-sectional configuration defining two separate rail channels or passageways which share a common wall. Such arrangements are generally known for use in supplemental windows to receive and guide the upper portions of window pane members 26 and 28. FIG. 8 shows an exploded perspective view of the upper left hand corner of channel 24. Specifically, the interaction of top section 30 (including U-channel 50 and top member 31), and left section 34 (including U-channel 50 and W channel member 52) is shown in FIG. 8. As can also be seen in FIG. 8, U-channel member 50 has a slot 51 therein. Slot 51 defines a spring-like member 53 on one side of U-channel member 50. When assembled (FIG. 9), spring-like member 53 exerts force on a sidewall of side U-channel member 50 to snugly position top section 30 within the side member 34.

Interior window assembly 10 is preferably manufactured as a modular unit for installation with frame 20 assembled, stained and finished first. Thereafter, peripheral channel 24 is secured to track 22 by adhesive foam tape 25 or other such means. One such suitable material for tape 25 is manufactured by Spectape. Ledge 23 is formed on the edge of track 22 to conceal tape 25 from sight after assembly. When channel 24 is in place, window pane members 26 and 28 are inserted into channel 24.

Top window pane member 26 includes, for example, a glass pane 106 surrounded by a peripheral rail formed by top element 108, bottom element 110, left side element 112 and right side element 114. Similarly, bottom window pane member 28 includes a glass pane 116 surrounded by a peripheral rail formed by top element 118, bottom element 120, left side element 122 and right side element 124. Each of these side elements is preferably formed from vinyl plastic and identical in cross-sectional configuration. That configuration overlaps and protects the sides of the glass panes in as with conventional window arrangements.

Top element 118 includes a glass engaging lower section 126 having a recess 128 with conventionally shaped, inwardly inclined ribs 130 therein to grip and protect the top edge of glass pane 116 when it is inserted into recess 128. Ledge 132 extends outwardly from section 126 toward the interior of the building. Interlocking ledge 134 extends outwardly from top element 118 toward window pane member 26. Top element 118 further includes longitudinal side slot 136, preferably along the entire longitudinal length of that top element. Compressible sealing member 138 is inserted within slot 136 and extends laterally outwardly toward window pane member 26. Sealing member 138 is, for example, formed from vinyl covered foam material, such as Q-Lon®.

A tilt latch member 140 is mounted at each longitudinal end of top element 118. Each tilt latch member is secured to top element 118 at pivot point 142 by a fastener, such as a rivet, which allows the tilt latch member limited rotational movement about pivot point 142. Tilt latch members 140 each preferably include side legs 144 and bight 146 between those side legs. Bight 146 limits the downward rotation of the tilt latch member and in doing so engages the upper surface of top element 118 and extends outwardly therefrom toward W-channels 52 and into channel 66. Side legs 144 are dimensioned to allow a close overlap with top element 118. Tilt latches 140 may also be employed with top window pane member 26 in a similar fashion. If so, M member 31 should be notched to accommodate latches 140.

Top element 108 is preferably identical in configuration to top element 118, except that top element 108 does not include a corresponding interlocking ledge or tilt latch members mounted thereon. Also, top element 108 preferably uses conventional weather stripping, such as wool pile, in its longitudinal side slot 136 rather than the coated foam seal suggested for top element 118. Both top elements are preferably formed as an extrusion from vinyl plastic.

Bottom element 110 includes a glass engaging upper section 148 having a recess 150 with conventionally shaped ribs 152 therein to grip and protect the bottom edge of glass pane 106 when it is inserted into recess 150. Lower section 154 is constructed as a longitudinally extending C-channel, for example, which is preferably integrally extruded with upper section 148 from vinyl plastic. Thus, C-channel includes an open slot 159 facing toward window pane member 28. A flat sealing surface 158 is, for example, provided at the junction of sections 148 and 154 above slot 158. Longitudinal reinforcing rod or insert 160 is disposed within the C-channel. This insert is formed from material which is more rigid than the material forming sections 148 and 154, preferably hollow, extruded aluminum. Insert 160 closely fits within the C-channel at least at the top and bottom interior surfaces, 162 and 164, respectively, and includes interlocking ledge 166 which extends outwardly from bottom element 110 toward window pane member 28. Insert 160 further includes, for example, upper interior chamber 168 and lower interior chamber 170. A pivot pin 172 is mounted into chamber 170 at each longitudinal end of bottom element 110 and extends outwardly toward W-channel member 52 for a predetermined distance. Pivot pins 172 are dimensioned so as to also be receivable with clearance space within apertures 104.

Bottom element 120 is, for example, identical in configuration to bottom element 110, except with respect to the longitudinal insert. With bottom element 120, insert 174 is employed. Like insert 160, insert 174 is relatively more rigid and closely fits within the C-channel. Unlike insert 160, insert 174 includes lifting tab or ledge 176 which extends outwardly from the C-channel slot toward the building interior. Leaving that slot, ledge 176 bends upwardly to clamp an outer wall 178 of bottom element 120 between the interior portion of insert 174 and ledge 176. Above outer wall 178 ledge 176 bends laterally away from bottom element 120. At the cantilevered end of ledge 176 longitudinally extending ribs 180 are formed to facilitate gripping of ledge 176 by users.

Each of top elements 108 and 118, bottom elements 110 and 120 and side elements 112, 114, 122 and 124 include a longitudinal cavity 182 for receiving a conventional fastener 184 which joins the respective elements in a conventional manner when these elements are mitered to form corners. Weather stripping 186 is provided on the side of side elements 112, 114, 122 and 124 and of top element 108 which faces toward the building exterior when window pane members 26 and 28 are assembled and installed into window assembly 10. Weather stripping 186 is mounted in longitudinal slots which are preferably inset a predetermined uniform distance from the outermost peripheral edge of those side and top elements. This weather stripping is preferably of a conventional nature, such as wool pile, having a compressible, fibrous exposed surface.

In operation, window pane member 26 and window pane member 28 are movable along the length of channels 64 and 66, respectively. When the side elements of those window pane members are received within those associated channels, the movement of each window pane member is along a longitudinally extending plane, as is conventional with double hung windows. However, since W-channels 52 are laterally movable within U-channel members 50, users can apply force to W-channels 52 to compress biasing arrangement 54 and move the opposing W-channels apart, allowing the side elements of the window pane members to be removed from channels 64 and 66.

This compressive force can be applied by squeezing W-channels 52 into U-channels 50 or by pulling the top element of the window pane member toward the building interior. In the latter case, the side elements of the window pane member would transfer the compressive force to W-channels 52 by sliding up inclined surfaces 84. In that regard movement of the side elements into and out of W-channels 52 resembles a snap-fit connection. As those side elements leave channels 64 and 66, the window pane members are retained within W-channel 52 by pivot pin 172 remaining within aperture 104. Thus, window pane members 26 and 28 can be pivotably moved out of the conventional planes of motion.

This pivotable movement allows both sides of each of the window pane members to be cleaned without removing the window pane members from the rest of the window arrangement. Further, such pivotable movement can facilitate access to the prime window for cleaning and/or maintenance. Although in preferred embodiments peripheral channel 24 is dimensioned so as not to block removal of prime window elements when window pane members 26 and 28 are removed, compressibility of W-channel 52 into U-channel 50 can provide further assistance in that regard.

Unlike prior devices, movement of window pane members 26 and 28 does not require simultaneous manipulation of unlocking mechanisms along with the application of motive force. For example, when pivotal movement of window pane member 28 is desired, tilt latch members 140 are rotated up so as to be clear of W-channel 52. Close engagement of side legs 144 with top element 118 typically allows tilt latch members 140 to remain in that "up" position unaided while the user subsequently pivots the window pane member out of W-channel 52. When movement of the window pane members along the conventional planes of motion is desired, no "unlocking" as such is typically needed: weight balancing elements 92 can provide sufficient friction or "drag" within channels 64 and 66 to retain the window pane member in any desired location unaided. After the user has moved the window pane member to a specific location, it can simply stay in that location until the user moves it again.

To completely remove a window pane member from the rest of the window arrangement the user can apply greater force to one side of the window pane member than to the other side, directed along the length of W-channel 52 toward bottom section 32. Since weight balancing elements 92 are independent of each other and there is sufficient clearance space between pivot pins 172 and apertures 104, such a differential in force will cause the coil spring 94 associated with one side of the window pane member to distend further than the coil spring 94 on the other side. Thus, the window pane member will be closer to bottom section 32 on one side than on the other side. According to the length pivot pins 172 project beyond the side elements of that window pane member, at a certain point the coil spring distension will allow the distance between apertures 104 to exceed the distance between the free ends of pivot pins 172 such that the pivot pins are removed from apertures 104 and the window pane member is thereby separated from the rest of the window arrangement.

The self locating compressibility of W-channel 52 within U-channel 50 can aid in this removal process since it allows aperture 104 to be inclined to some extent along with the incline of the bottom element of the window pane member and compressed away from pivot pins, toward U-channel 50, at the same time. Thus, less clearance space is needed within apertures 104 to accommodate pins 172. At the same time, less downward force is needed on one side of the window pane member in order to achieve separation.

Each W-channel 52 is preferably self locating in that it accommodates localized compression into U-channel 50: squeezing W-channel 52 at one end thereof does not, for example, cause the other end of that W-channel to move toward the U-channel. Thus, a window pane member which is out of square can be mounted within window arrangements of the present invention without creation of air flow gaps between the window pane member and the left and right sections of peripheral channel 24. Further, the structure of W-channels 52 and biasing arrangements 54 are designed to apply a predetermined amount of pressure evenly to the side elements of window pane members. This pressure holds the side elements evenly within W-channel 52 and into sealing engagement with sleeves 88 to restrict air flow through the subject window arrangements.

Additional devices are also preferably employed to restrict air flow. For example, the difference in the angles of incline between inclined surfaces 84 and 86 creates a biasing force urging weather stripping 186 into engagement with ribs 90. This engagement causes localized compression within weather stripping 186 and a more torturous air flow path past the weather stripping. These features have been found to avoid the mid-side leaks found in prior windows without requiring the additional reinforcing structure, such as lateral pins, commonly needed in prior windows. Also, interlocking ledges 134 and 166 tend to draw and maintain window pane members 26 and 28 into close relation and maximize the effectiveness of sealing member 138. In addition, rail rib 47 forms a non compressible, friction fit seal with bottom element 120.

To maintain the effectiveness of these sealing devices over time, the present invention provides increased strength and stiffness for the window pane members through inserts 160 and 174. Thermal efficiency is maximized by forming the rest of the peripheral rails from vinyl plastic and shielding inserts 160 and 174 from exterior temperatures. Vinyl is lighter weight and less thermally conductive than the metal from which inserts 160 and 174 are formed. With the placement of inserts 160 and 174 within bottom elements 110 and 120 the vinyl components are not required to support all of the stresses, such as weight, applied to the window pane members. Thus, the vinyl components are less susceptible to sag and warp distortion and sealing against air flow through the window arrangement remains effective.

The impact of the weight of even very large window pane members upon the user is minimized by weight balancing elements 92 and the pivotable mounting discussed above. Weight balancing elements 92 can be adjusted to accommodate the force the user desires to employ for window movement, and the pivotable mounting minimizes the need to actually lift large windows out of the frame. At the same time, this structure is compactly arranged and prefabricated for modular installation.

Figure 10:
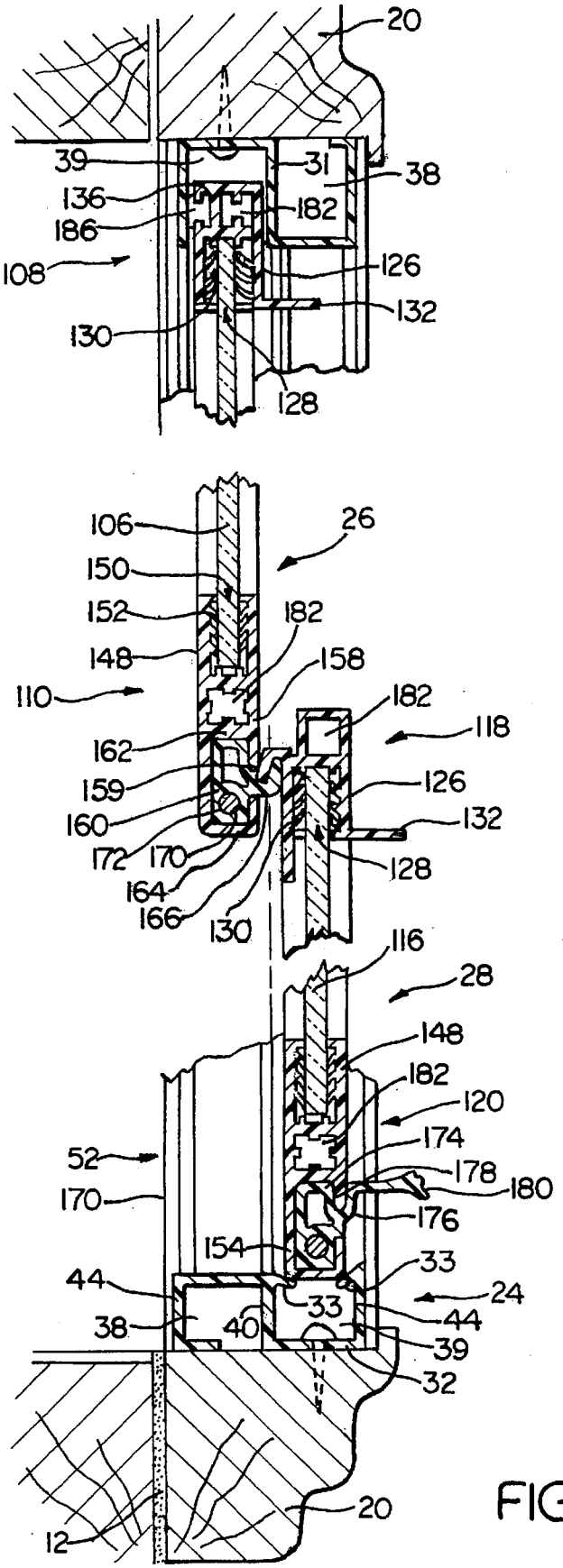
FIG. 10 is a cross-sectional view of another embodiment of an interior storm window according to the present invention.

Another embodiment of the present invention is shown in FIG. 10, where like reference numerals refer to like elements in the above-described embodiment. As shown in the bottom portion of FIG. 10, bottom section 32 has a substantially S-shaped configuration, as opposed to the W or dual U shown in the above embodiment. Bottom section 32 has a closed channel 38 and an open channel 39. Two legs 33 run the length of bottom section 32 along the opening to open channel 39. Bottom section 32 is preferably extruded from a dual durometer material such that legs 33 are more flexible than the remaining portions of bottom section 32. Because legs 33 are somewhat flexible, the weight of window pane member 28 causes them to flex downward toward open channel 39 when window pane member 28 is closed. This creates a relatively close seal between legs 33 and lower section 154 of bottom element 110. Thus, the thermal efficiency of the window unit is improved by reducing the space available for air flow underneath window pane member 28.

FIG. 10 also shows an alternative embodiment of the upper portion of window pane 26. Specifically, top member 31 is a generally S-shaped element having a closed channel 38 and an open channel 39. However, unlike bottom member 32, open channel 39 does not have legs 33 disposed along the opening thereto. Rather, weather stripping 186 is disposed in slot 136 of top element 108 to assist in providing the desired thermal characteristics.

Although the present invention has been described in detail above, the same is by way of illustration and example only and is not a limitation upon the scope of invention. Those of ordinary skill in the art will now appreciate that various modifications can be made to the embodiments described above without departing from the spirit and scope of this invention. For example, lower section 154 of bottom elements 110 and 120 does not have to be a C-shaped channel. Rather, any configuration which allows for insertion of a sufficiently rigid member 160 or 174 while still maintaining the relatively narrow profile required of a storm window can be utilized. Additionally, although weight balancing elements 92 are shown as a spring and shoe type, other known weight balancing elements, such as screw type balances, may be utilized. Accordingly, the spirit and scope of this invention are to be considered to be limited only by the terms of the claims below.

What is claimed is:

1. A double hung storm window comprising:

a first window member and a second window member;

peripheral channels for separately receiving said first and second window members and retaining those window members in offset and adjacent relation such that at least one of said window members is linearly movable within said channels;

said window members each including top, bottom and side elements surrounding at least one glass pane, said top, bottom and side elements being formed from plastic material having relatively low thermal conductivity;

said bottom element of said first window member including a first channel portion extending its longitudinal length and having an opening facing the building interior side of the window arrangement, as mounted to a building; and a first, relatively more rigid insert disposed within said first channel portion beneath said first window member.

2. The storm window according to claim 1, wherein said first channel portion of said bottom member is generally C-shaped.

3. The storm window according to claim 1, wherein said first rigid insert includes a portion extending out of said opening and along an exterior surface of said first channel portion to form a ledge to facilitate user manipulation of said first window member.

4. The storm window according to claim 1, wherein the bottom element of said second window member includes a second channel portion extending its longitudinal length and having an opening facing toward said first window member, a second, relatively more rigid insert is disposed within said second channel portion to support the vertical load of said second window member, said second rigid insert including a top locking portion extending out of the opening of said second channel portion, said top element of said first window member including a bottom locking portion extending toward said second window member, said top locking portion and said bottom locking portion being matingly receivable so as to maintain the top element of said first window member and the bottom element of said second window member closely adjacent when said window is in a closed position.

5. The storm window according to claim 1, further comprising a sealing member disposed between and in contact with said top element of said first window member and said bottom element of said second window member when said storm window is in a closed position.

6. A storm window assembly comprising:

first and second window members, each of which includes a peripheral rail about a pane portion;

first and second opposing multi-channel elements for receiving therebetween the peripheral rails of both said first and second window members;

first and second single channel elements for receiving, respectively, said first and second multi-channel elements;

said first and second single channel elements being dimensioned such that said first and second multi-channel elements are laterally movable therein;

a biasing arrangement within each of said first and second single channel elements for urging said first and second multi-channel elements toward each other and into contact with said peripheral rails; and each of said multi-channel elements including a first and a second rail channel, each of said raft channels including a first and a second spaced apart, opposing inclined surface, each pair of said opposing inclined surfaces engaging an end of one of said peripheral rails when said window members are received within said multi-channel elements.

* * * * *